US006635141B2

(12) United States Patent
Horsfield et al.

(10) Patent No.: US 6,635,141 B2
(45) Date of Patent: Oct. 21, 2003

(54) ENGINEERED WOOD MEMBER AND METHOD OF ITS MANUFACTURE

(75) Inventors: Brian C. Horsfield, Federal Way, WA (US); Gerald A. Ziegler, Orting, WA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/981,693

(22) Filed: Oct. 12, 2001

(65) Prior Publication Data

US 2002/0043042 A1 Apr. 18, 2002

Related U.S. Application Data

(62) Division of application No. 09/422,582, filed on Oct. 21, 1999, now Pat. No. 6,318,046.

(51) Int. Cl.[7] ..... B32B 31/00

(52) U.S. Cl. ..... 156/264; 156/257; 156/268; 156/298; 156/512; 144/344; 144/345; 144/346; 144/348; 144/352; 144/353; 144/355

(58) Field of Search ..... 144/346, 348, 144/352, 353, 355, 344, 345; 52/730.7, 731.1; 156/91, 92, 257, 264, 268, 298, 512, 559, 304.1, 304.3, 304.5, 304.6; 428/57, 58, 60

(56) References Cited

U.S. PATENT DOCUMENTS

| | | | | |
|---|---|---|---|---|
| 1,492,799 A | | 5/1924 | Houston | 52/30.7 |
| 2,421,305 A | | 5/1947 | Wachsmann et al. | 52/730.7 X |
| 3,949,529 A | | 4/1976 | Porter | 52/733.2 X |
| 4,413,459 A | | 11/1983 | Lambuth | 52/729 |
| 5,003,742 A | | 4/1991 | Dettbarn | 52/733.2 X |
| 5,299,400 A | * | 4/1994 | Sing | 52/309.9 |
| 5,653,080 A | | 8/1997 | Bergeron | 52/729.4 |
| 5,865,929 A | * | 2/1999 | Sing | 156/264 |
| 5,870,876 A | | 2/1999 | Deiter | 52/731.1 |
| 5,896,723 A | | 4/1999 | Sing | 52/730.7 |
| 6,025,053 A | | 2/2000 | Grenier | 52/730.7 X |
| 6,125,607 A | | 10/2000 | Poce | 52/730.7 |

* cited by examiner

*Primary Examiner*—Linda Gray

(57) ABSTRACT

The invention is a wane-free engineered wood product and the method of its manufacture. Lumber having wane along one or more edges is first milled to produce rectangular notches along each of the four edges. The notches are sized to remove all or most of the wane. The notched piece is then ripped lengthwise to produce two strips. These are rotated 180° and placed adjacently so that the notched edges face each other and form longitudinal channels. Strips of oriented strand board or a similar material are then affixed into the channels, preferably by gluing, reuniting then again into a unitary wane-free structural member.

7 Claims, 2 Drawing Sheets

ENGINEERED WOOD MEMBER AND METHOD OF ITS MANUFACTURE

This application is a division of Ser. No. 09/422,582, filed Oct. 21, 1999 and now U.S. Pat. No. 6,318,046

The present invention is directed to an engineered wood member and to its method of manufacture. The members are particularly useful as studs for building construction.

BACKGROUND OF THE INVENTION

Even after hundreds of years, wood framing remains the method of choice for building construction in the United States and many other parts of the world. However, the forest economy has within the past two decades turned from an emphasis on harvesting huge old growth trees to much smaller plantation grown trees. Much of this plantation stock has been grown from genetically improved seedlings selected for rapid growth, high density, and many other desirable heritable characteristics. Along with the change in the nature and size of logs, sawmilling has also evolved into mills that can rapidly process the smaller trees into lumber. Many mills now use chipper-canters which first convert wood along the sides of the logs into pulp chips and leave a cant with parallel sides of a predetermined width. If the log was sufficiently large, side boards may be taken off the initial cant leaving a center cant to be cut into additional boards, usually in an automated gang saw. Scanners are widely used to measure the logs and set the saws to determine the breakdown pattern. Larger logs will yield side boards and a center cant. In order to maximize yield, wane will often be allowed along the corners of some pieces. Wane results from the piece not entirely fitting into a prescribed cross sectional rectangle for all or part of its length so that some of the original surface adjacent to the bark remains along one or more edges. Grading rules permit minor wane for most lumber grades but excessive wane is cause for downgrading or rejection of an individual piece.

Wane and other edge defects on lumber are particularly annoying to builders. Wall studs may be taken as an example. These have other materials nailed to them including sheathing and siding on the exterior and gypsum drywall on the interior. For ease of nailing and solidity of construction a sound, full width flat surface is desirable.

Coniferous trees have a core portion of juvenile wood about 10–15 growth rings wide. This core wood is known to be less dense and generally weaker than wood formed later during the trees growth. It is inherent that lumber having wane will have come from the outside portion of the log from which it was cut and will generally be of higher strength and stiffness than that cut from the core portion of the log. If the trees have been pruned during their growth, lumber from the outside will also usually have a lower amount of defects such as knots. For these reasons it is desirable to convert this wood into the highest value product possible. Removing any wane without substantial loss in yield would be a major step in increasing lumber value since the affected lumber generally has prime structural characteristics.

The present invention offers a solution to the problems caused by wane and presents a premium product that is wane free and full sized. The product can be made by upgrading pieces having moderate wane without loss in lumber dimensions.

SUMMARY OF THE INVENTION

The present invention is directed to an engineered wood construction member of rectangular cross section having flat edges free of wane, manufacturing damage, and other surface defects. The invention is further directed to the method of manufacture of the product. The wood member is particularly useful as studs for wall framing but not so limited. The member is formed from two side-by-side opposed wood strips. The upper and lower a corners of the adjacent faces of the strips have been cut away to form rectangular notches running the full length of the strips. Wood-like splines affixed top and bottom into the notches join them into a unitary member.

The process for making the members is carried out in a sequence of steps. A lumber piece having wane along one or more edges is first milled to produce rectangular notches along each of the four corners. The piece is then sawn lengthwise through the shorter of the cross sectional dimensions. Each resulting strip is then turned or rotated 180° and the strips are placed side-by-side so that the notched corners are adjacent to each other and, in essence, form longitudinal channels. A wood-like material is then fitted into the channels formed by the notches and solidly attached in place as by adhesive bonding, stapling, nailing or other mechanical means to again form the two strips into a unitary member. The two sides and/or the faces may optionally be lightly planed or sanded to produce smooth surfaces. The strips may be in contact with each other or they may be placed slightly apart; e.g. up to about 1–75 mm, in the finished member. Some of the lumber width will be lost to saw kerf when the piece is ripped lengthwise. By including a small space between the strips the dimensions of the original lumber piece may be restored. Using the wider spacing, a nominal 2×4 board can be expanded into a 2×6.

The splines may be made of wood or a reconstituted wood product such as oriented strand board. Other materials of a wood-like nature may also be used such as hardboard, or particleboard. The term "wood-like" should be construed sufficiently broadly to include any material of sufficient structural strength and rigidity that can be readily attached and worked with conventional wood working tools. Oriented strand board adhesively bonded into the channels is preferred.

The invention will be more readily understood by reference to the following detailed description taken in conjunction with the drawings.

DETAILED DESCRIPTION OF THE PREFERRED EMBODIMENTS

Figure 1:
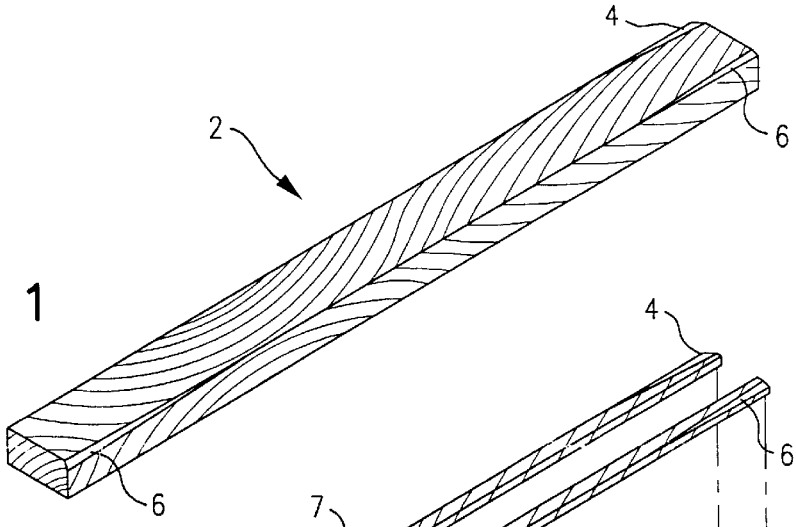
FIG. 1 shows a conventional piece of lumber having wane at three locations.
Figure 2:
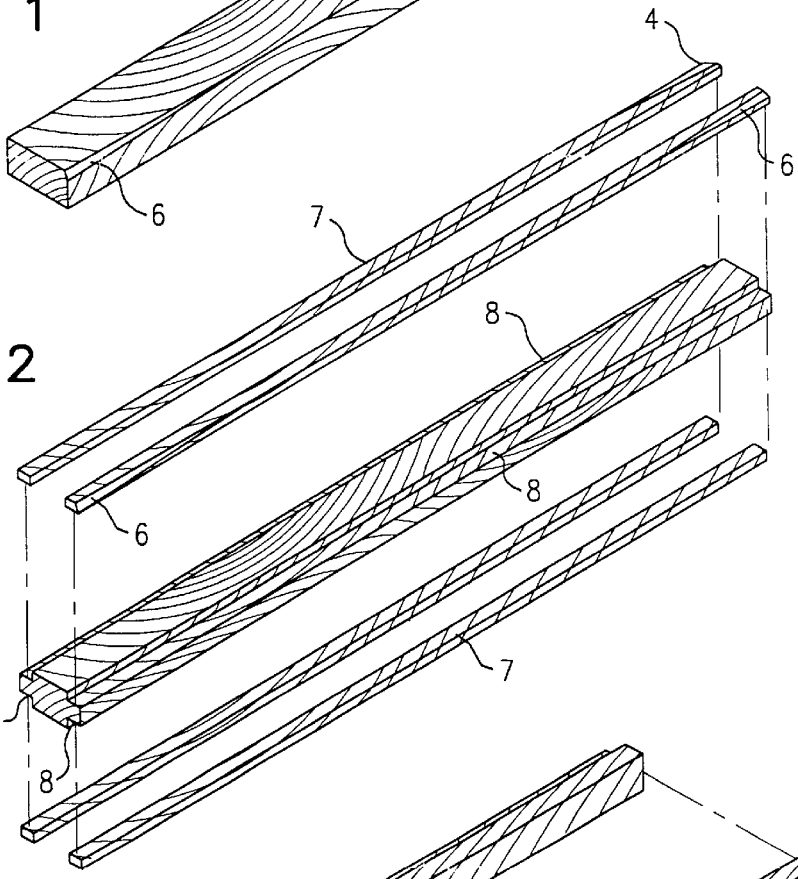
FIG. 2 shows the first process step when each of the corners is notched longitudinally.
Figure 3:
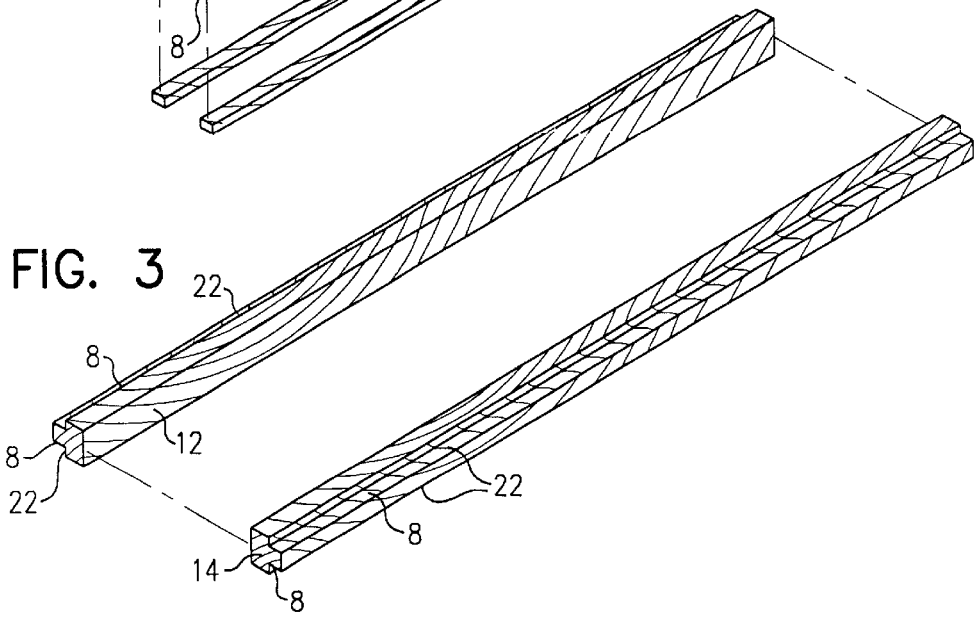
FIG. 3 shows the notched piece sawn longitudinally into two strips.
Figure 4:
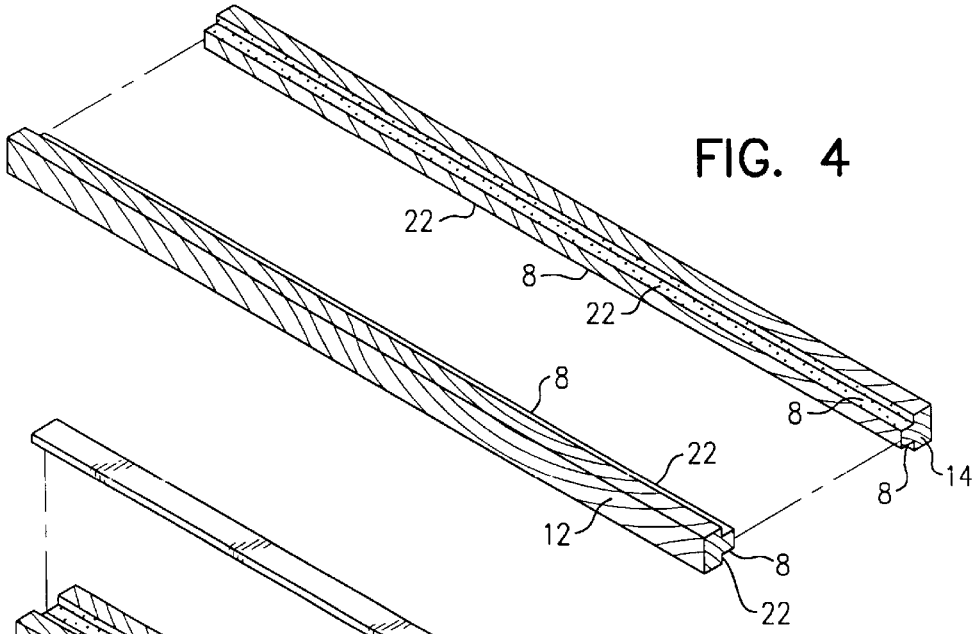
FIG. 4 shows the strips each rotated or turned 180°.
Figure 5:
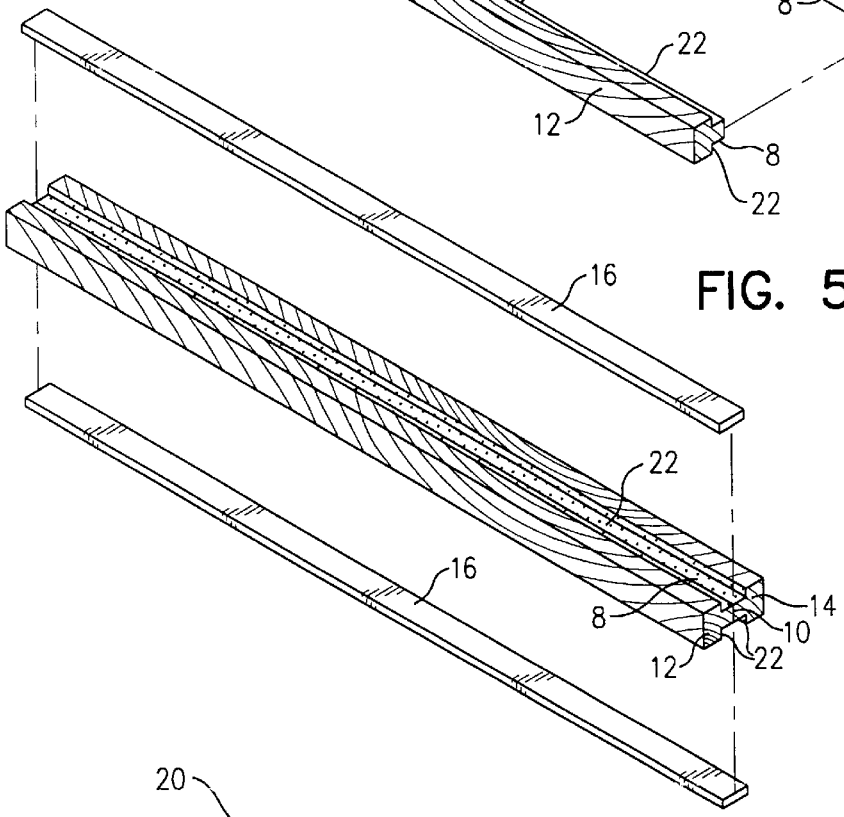
FIG. 5 shows the strips placed adjacent to each other with splines ready to be placed into the resulting channels.

Referring now to the drawings, FIG. 1 depicts a piece of lumber 2; e.g., a nominal 2×4 stud, having wane 4, 6 along the upper corners. In FIG. 2 the piece is milled to remove sections 7 leaving longitudinal notches 8 of rectangular cross section along each corner. While the drawing indicates for clarity that sections 7 are removed intact, in practice they would normally be converted into chips by a milling cutter. The lumber with the corners notched is then ripped lengthwise into individual pieces 12, 14, as seen in FIG. 3. Each piece is then rotated 180° so that the edges with the notched corners face each other, shown in FIG. 4. A durable adhesive 22 may be applied in the notches at this time. In FIG. 5 is seen the two pieces 12, 14 located closely adjacent with splines 16 of oriented strand board or similar material ready to be placed in the longitudinal channels formed by adjacent notches 8. A gap 10 may be allowed between strips 12, 14 to restore the finished member to the original width of the lumber piece.

The adhesive 22 may be applied to the splines 16 rather than to the notches. The adhesive may be any of those commonly used in the wood industry such as polyvinyl acetate, heat curing phenolics or polymethylene diisocyanates. Alternatively, the splines 16 may be fixed in place by stapling, nailing, or other attachment means, with or without adhesives.

Figure 6:
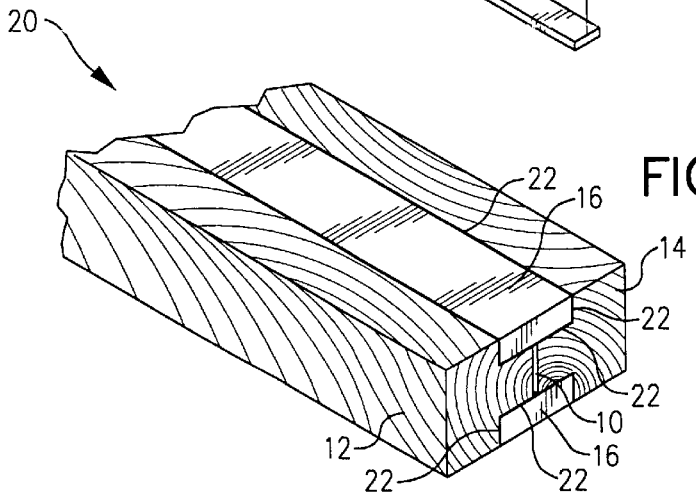
FIG. 6 shows the completed wood member.

FIG. 6 shows the completely assembled engineered lumber member 20. Wane has been removed from the edges which now present flat, full thickness surfaces free of major defects for their entire length.

As one suitable construction, splines may be of oriented strand board with a thickness of about 10 mm (⅜ inch) and width of about 55 mm (2⅛ inch). These dimensions are not critical.

It will be readily evident that minor variations can be made in the product and its method of manufacture that have not described here. It is the intent of the inventors that these variations should be included within the scope of the invention if encompassed within the following claims.

We claim:

1. A method of making an engineered wood member from lumber having wane on one or more edges which comprises:

making rectangular cutouts along each longitudinal corner of the lumber to form notches and essentially remove wane;

sawing the lumber longitudinally through the smaller cross sectional dimension to rotating each strip 180° and placing them so side-by-side so that the notched corners are adjacent to each other;

providing strips of a wood containing material of dimensions suitable for fitting into the opposing notches; and affixing the strips of wood containing material into the notches to form splines and reform the strips into a unitary lumber member lacking wane on the outer longitudinal corners.

2. The method of claim 1 which further comprises adhesively bonding the strips of wood containing material into the notches.

3. The method of claim 1 which further comprises stapling the strips of wood containing material into the notches.

4. The method of claim 1 which further comprises nailing the strips of wood containing material into the notches.

5. The method of claim 1, 2, 3, or 4 in which the wood containing material is oriented strand board.

6. The method of claims 1, 2, 3, or 4 which further comprises lightly planing the member to assure smooth surfaces.

7. The method of claims 1, 2, 3, or 4 which further comprises lightly sanding the member to assure smooth surfaces.

* * * * *